US005768711A

United States Patent [19]

Wissink

[11] Patent Number: 5,768,711

[45] Date of Patent: Jun. 23, 1998

[54] SPORTS GLOVE

[75] Inventor: Daniel E. Wissink, Oshkosh, Wis.

[73] Assignee: Schiek Sports, Oshkosh, Wis.

[21] Appl. No.: 781,317

[22] Filed: Jan. 9, 1997

[51] Int. Cl.[6] ..... A41D 19/00

[52] U.S. Cl. ..... 2/161.1; 2/160; 2/163

[58] Field of Search ..... 2/159, 160, 161.1, 2/161.6, 163; 441/55, 56, 57, 58; D2/617, 619; D21/238, 239

[56] References Cited

U.S. PATENT DOCUMENTS

| | | | |
|---|---|---|---|
| 1,206,102 | 11/1916 | Gibson | 2/159 |
| 1,329,073 | 2/1920 | Czicziriga | 2/159 X |
| 2,713,171 | 7/1955 | Talbot | 2/159 |
| 4,796,306 | 1/1989 | Mitchell | 2/160 |
| 5,004,227 | 4/1991 | Hoffman | 2/159 X |
| 5,022,094 | 6/1991 | Hames et al. | 2/159 X |
| 5,224,220 | 7/1993 | Andriola | 2/160 |
| 5,276,922 | 1/1994 | Floyd | 2/160 |
| 5,390,371 | 2/1995 | Sigward | 2/159 |
| 5,592,695 | 1/1997 | Roche | 2/160 X |

*Primary Examiner*—C. D. Crowder
*Assistant Examiner*—Shirra L. Jenkins
*Attorney, Agent, or Firm*—Mark A. Tidwell; Robert C. Curfiss; Bracewell & Patterson

[57] ABSTRACT

A glove with projections or tabs attached to the thumb and finger sheaths of the glove. The tabs can easily be grasped to provide an axial removal force along each finger sheath, thus enhancing removal of the glove from a wearer's hand. In one embodiment, each tab is an integrally formed triangular fin attached to the top portion of each glove finger at the distal-most end of the glove finger. The tabs permit the application of an axial force along each finger and have been found to be particularly effective in removing sports gloves that are provided with one-half and three-quarter finger sheaths that fit snugly around a wearer's fingers. In another embodiment, the tabs project beyond the ends of the finger sheaths.

9 Claims, 3 Drawing Sheets

SPORTS GLOVE

BACKGROUND OF INVENTION

1. Field of Invention

The invention relates to an apparatus for enhancing the removability of gloves, especially sports gloves of the type having partial-fingers.

2. Description of the Prior Art

Athletes often utilize gloves to enhance performance and to avoid injury, especially when the sporting activity requires that the athlete tightly grasp an object, such as a weightlifting bar or a water ski tow bar. In industry, gloves are often utilized as a means for protecting workers from vibrations generated by various equipment. A common problem associated with these types of activities is the development of calluses on the palm and inner portions of the fingers. In addition, repeated exposure to vibrations can cause damage to the systems of the hands and arms, such as the nervous system, the muscular system or the skeletal system. These problems are typically addressed by providing a glove that is heavily padded in the palm area.

Another feature of sporting gloves of the type described above is that the fingers of the gloves extend only partially down the length of the wearer's fingers, commonly either one-half or three-quarters the length of the wearer's fingers. The tips or ends of the wearer's fingers remain uncovered or exposed to permit unencumbered feeling. The length of the partial glove fingers is generally dependent on the degree of padding provided for the fingers. Typically, only the most proximal digits of the hand are subject to calluses, and therefore, only this portion of the user's fingers are padded. The material covering the fingers and supporting the padding generally extends only slightly beyond the padding material. Finally, such glove fingers are designed to fit snugly around the wearer's fingers and therefore are not loose as is most common in gloves utilized for other purposes such as for warmth or fashion.

One of the problems with sports gloves such as is described above is the removability of the glove. Because the glove fingers are only partial and because they are designed to fit snugly around the finger's of the wearer, the glove is often difficult to remove. Usually, one is forced to remove such a glove through an iterative process of grasping the lip of an open end of a glove finger, pulling on the glove finger to ease the glove finger forward until further removal is inhibited by the other portions of the glove, proceeding to the adjacent finger and repeating the process. In this way, the fingers of the glove can slowly be inched down one's hand until the glove is removed. Another common method for removal is simply to peel the gloves off such that the gloves are inside-out. The user must then restore the gloves to their original form before further use. Of course, removal becomes even more difficult if the glove material is less elastic, e.g., leather, or if the glove is sweaty.

There have been several solutions proposed by prior art gloves to enhance removability. U.S. Pat. No. 5,004,227 describes an exercise gloves having half-fingers, in which the glove is provided with a pocket on the back of the glove for receiving exercise weights. The glove also has loops between the fingers to aid in removal of the glove. Specifically, the loops between the fingers permit a user to insert the fingers of the opposite hand into the loops and remove the glove by pulling outward from the gloved hand.

U.S. Pat. No. 5,025,502 describes a glove that incorporates a mouthpiece with an air passage. The mouthpiece allows the wearer to partially inflate the interior or the glove, thus aiding in removal.

U.S. Pat. No. 5,224,220 describes a glove that is provided with a string attached to the end of each glove finger. The string extending from each glove finger attaches to a hook and loop type fastener tab which can be secured to the back of the gloved during use. When removal of the glove is desired, the fastener is disengaged and an axial removal force is applied to each finger of the glove by pulling on the tab to which the strings are attached.

Finally, U.S. Pat. No. 5,444,874 describes a hand glove that is provided with three temporarily securable flaps located on the back hand portion of the glove. The patent teaches that release of the flaps enhances removal of the glove.

SUMMARY OF THE INVENTION

The subject invention provides projections or tabs positioned on the distal ends of the glove fingers such that the problems with glove removal are overcome. In one embodiment, the tabs are in the form of triangular shaped fins attached along the tops of the glove fingers. The fins may be integral with the material that forms the glove fingers. Furthermore, since it is desirable that athletic gloves fit snugly around a wearer's fingers, the formation of the fins can be used to enhance a snug fit. Instead of trying to grasp the lips of the glove fingers as in the prior art, the fins can be grasped and tugged. This also speeds up removal since more force can be a applied to an individual fin obviating the need for the iterative process described above. In another embodiment, the tabs are projections which extend beyond the covered portions of the wearer's fingers.

DETAILED DESCRIPTION OF THE PREFERRED EMBODIMENTS

Figure 2:
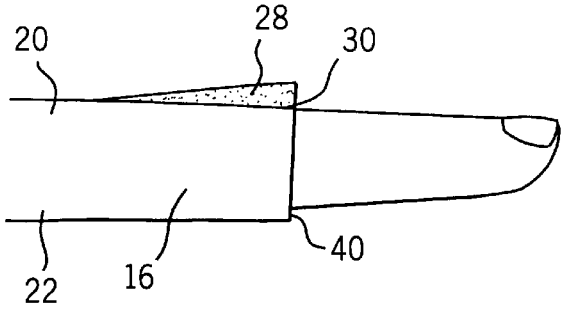
FIG. 2 is a side view of a glove finger as shown in FIG. 1.
Figure 1:
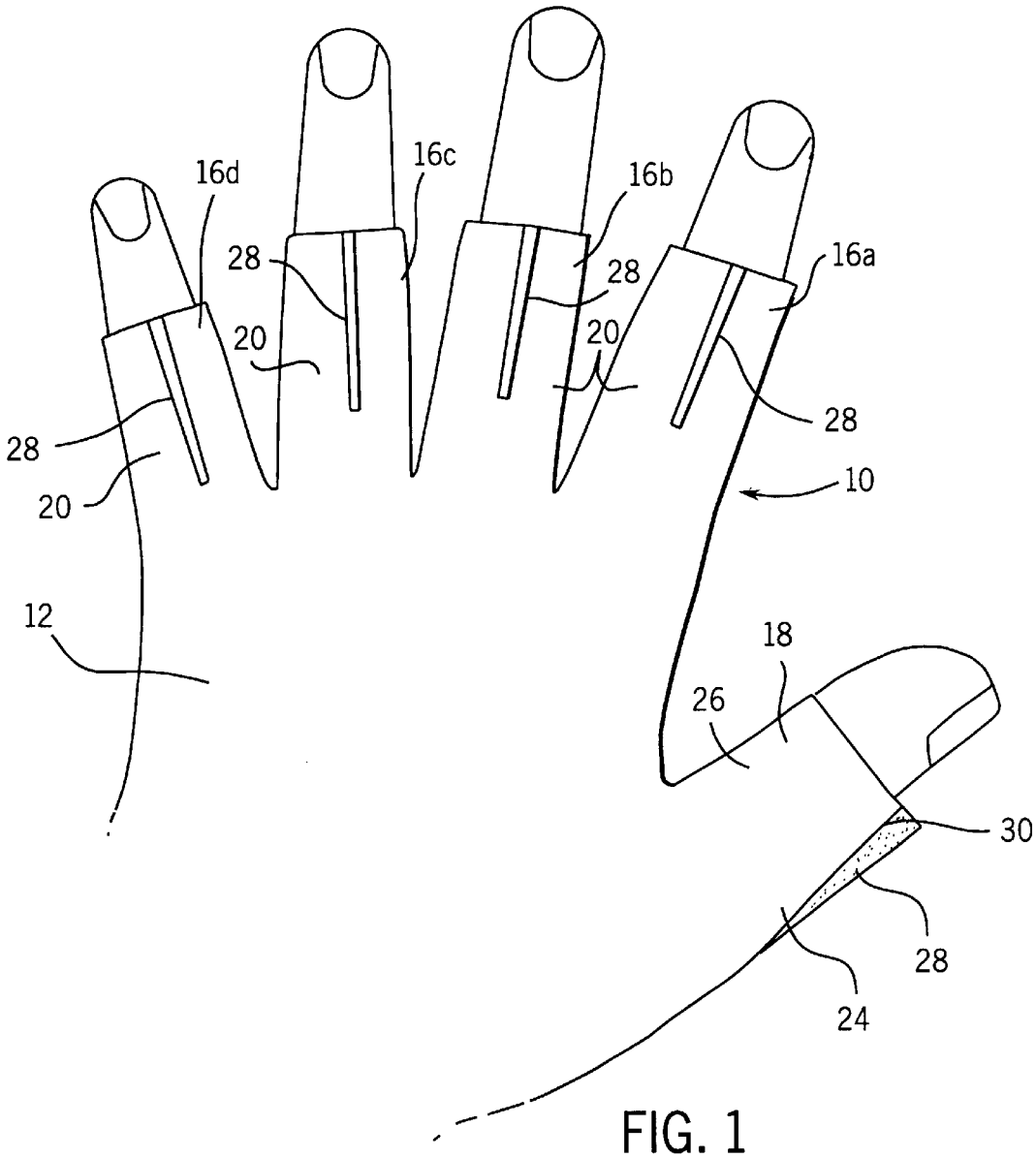
FIG. 1 is a top view of the glove of the instant invention illustrating triangular fins on the tops of a glove having partial finger sheaths.
Figure 3:
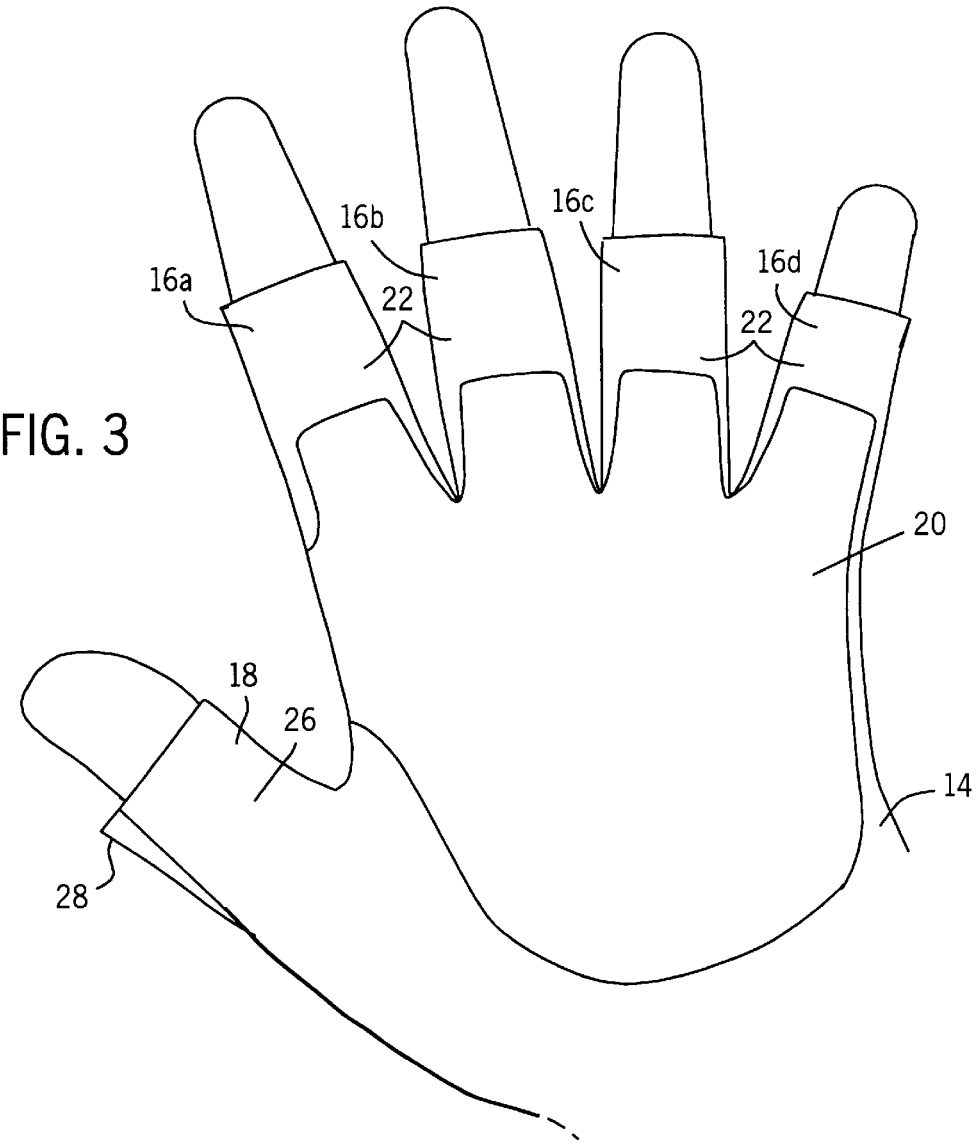
FIG. 3 is a bottom view of the of the glove of FIG. 1.

With reference to FIGS. 1, 2 and 3, sports the glove of the present invention is shown and designated as 10. It is understood that although the Figures illustrate the invention used in conjunction with a left-handed glove, a right-handed glove is a mirror image of the left-handed glove and is similarly configured. Glove 10 is generally comprised of a top portion 12, a bottom or palm portion 14, first, second, third, and fourth finger sheaths 16*a*–16*d* and a fifth thumb finger sheath 18. Finger sheaths 16–*d* and are defined by an upper or the portion 20 and a lower a bottom portion 22. Likewise, thumb finger sheath 18 is defined by an upper or top portion 24 and a lower or bottom portion 26. An outwardly facing pad 20 may be disposed on palm portion 14. Pad 20 may extend up along the lower portions 22 of finger sheaths 16*a*–*d*. At least one finger sheath has an open end 40, resulting in a partial finger sheath, through which a finger extends such that a portion of the finger is exposed and provides for a partially clad finger.

Separately formed along each finger and thumb finger sheath 16*a*–*d*, 18 is tab 28. Tabs 28 are directly attached on a single finger sheath a does not extend beyond the end of the exposed finger. Tabs 28 are similar for both the thumb and finger sheaths and therefore, only the finger sheaths will be referenced during the following discussion. In the preferred embodiment shown in FIGS. 1 and 3, tabs 28 take the form of triangular fins attached to the upper portions 20 of finger sheaths 16*a–d*. Each fin is integrally formed from a finger sheath 16 by utilizing excess material of finger sheath 16 to form the triangular shape and then providing a seam 30 at the base of the fin where it joins the finger sheath. A further advantage of taps formed in this manner is that the finger sheaths can be manufactured to more snugly fit around a wearer's fingers.

Tabs 28 may take any shape such as an elliptical contour, although it has been found that a triangular shape such as is shown in FIGS. 1 and 2 is most effective. Specifically, the widest cross-section of the triangle is provided at the distal end of finger sheath 16 and the triangle tapers back along the length of finger sheath 16. Thus, tab 28 is provided with a portion that is wide enough to be easily grasped and manipulated, yet tapers off so that tab 28 is not easily snagged and is aesthetically pleasing. In addition, such a configuration permits easy adjustment of the fit of the finger sheaths as mentioned above.

Those skilled in the art will understand that tabs 28 may be placed at any location along the thumb and finger sheaths. The invention is not limited to positioning tabs 28 on the top of the sheaths. For example, tabs 28 may be located on the lower portion of the sheaths adjacent the palm portion of the glove. However, by positioning tabs 28 along the upper portions of the fingers and thumb as is shown in the preferred embodiment of FIGS. 1–3, tabs 28 are easier to manipulate and less likely to interfere with one's grip during use.

It has also been found that positioning tabs 28 at the distal most portion of the sheaths further enhances removal. During glove removal, tabs 28 are grasped and urged outward from the wearer's hand. This initiates an axial force along the finger of the glove. The closer the point of application of this force to the distal end of the finger, the more readily the finger sheath is removed from about the wearer's finger. Typically, the finger sheaths tend to bunch up if the removal force is applied to close to the proximal end of the finger. Furthermore, because the nature of many athletic gloves is that the fingers of the gloves are designed to snugly fit around a wearer's fingers, removal is exacerbated. Thus, positioning tabs 28 at the distal most end of the finger sheaths optimizes the removal force.

Tabs 28 may be formed of material that is attached to the finger sheath in any known manner. For example, a triangular portion of fabric may be sewn to the finger sheath, or material may be allowed to protrude from the seam of the finger sheath. In any event, tab 28 provides a projection which can be more easily grasped and manipulated than attempting to grasp the finger sheath itself.

Figure 5:
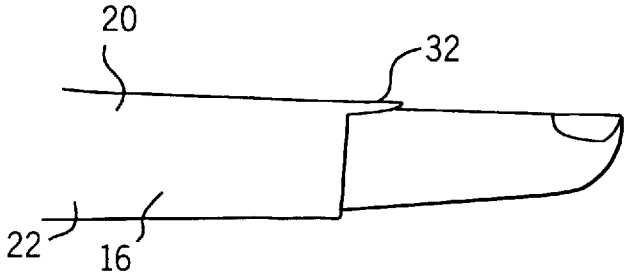
FIG. 5 is a side view of a glove finger as shown in the embodiment of FIG. 4.
Figure 4:
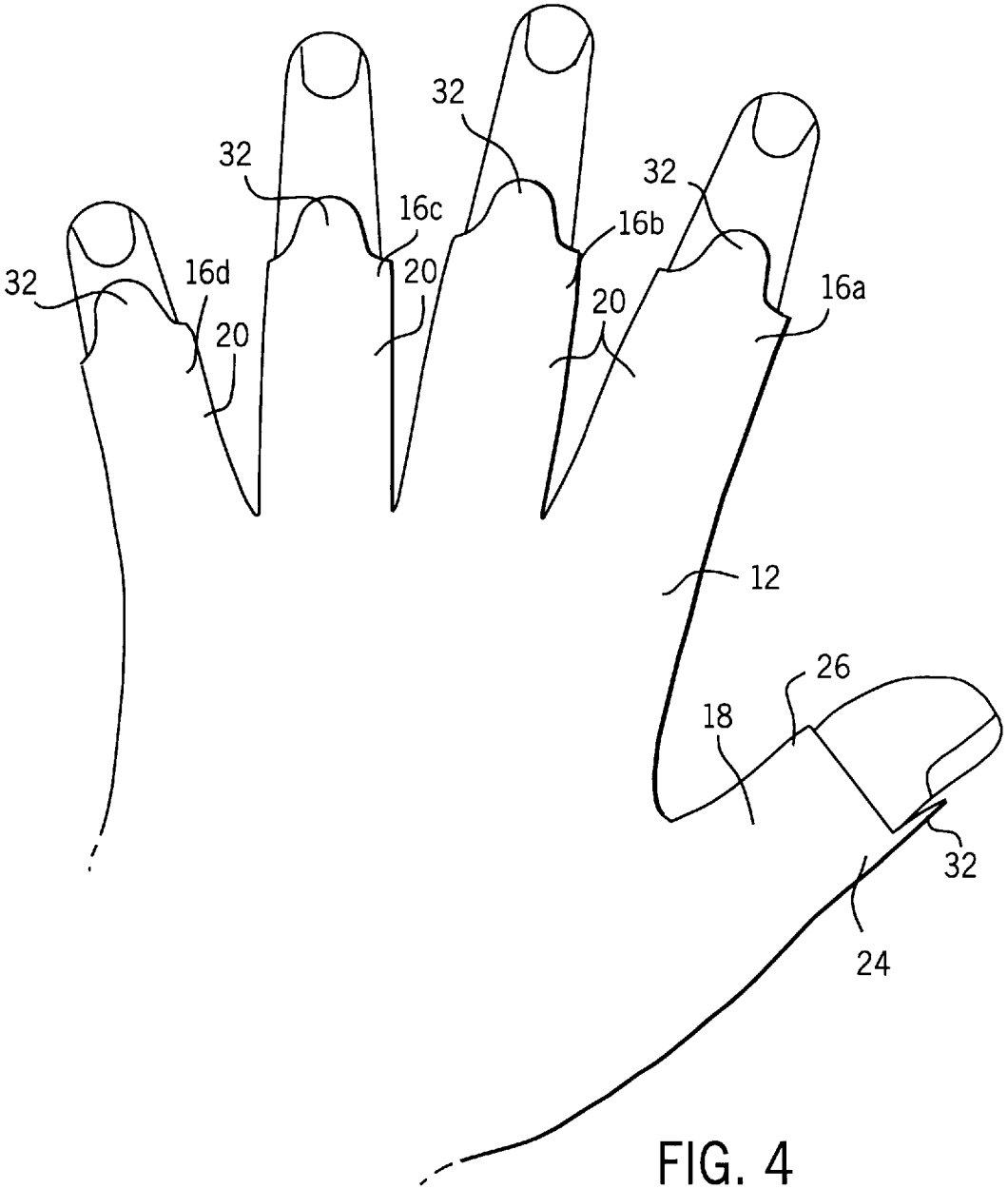
FIG. 4 is a top view of another embodiment of the invention in which the removal tabs extend beyond the end of the sheathed fingers.

In another embodiment shown in FIGS. 4 and 5, the removal tabs are shown as sheath extensions 32 that project beyond the end of finger sheaths 16. Again, these extensions 32 can be integrally formed from finger sheaths 16*a–d* or separately formed and attached utilizing any standard material and form of attachment.

The above described invention provides a projection or tab that can easily be grasped to provide an axial removal force along each finger. In the most preferred embodiment, the tab takes the form of a triangular fin attached to the top portion of each glove finger at the distal most end of the glove finger. The tabs permit the application of an axial force along each finger and have been found to be particularly effective in removing sports gloves that are provided with partial-finger sheaths that fit snugly around a wearer's fingers.

While certain features and embodiments of the invention have been described in detail herein, it will be readily understood that the invention encompasses all modifications and enhancements within the scope and spirit of the following claims.

What is claimed is:

1. A sports glove having partially clad fingers said glove for receipt of a hand having a palm, a back, and fingers, the top of the fingers having a nail portion, the glove comprising:

a. at least two partial finger sheaths, said partial finger sheaths each having a top and bottom portion and an open end through which a finger extends such that a portion of the finger is exposed;

b. a palm covering disposed adjacent the palm of the hand;

c. a back covering disposed adjacent the back of the hand;

d. at least two tabs, each attached directly on a separate single, partial finger sheaths, wherein said tabs do not extend beyond the end of the exposed fingers.

2. The glove of claim 1 wherein said tabs are triangular fins.

3. The glove of claim 1 wherein said tabs are disposed on the top portion of the finger sheaths.

4. The glove of claim 1 wherein one of said fingers is a thumbs and one of said finger sheaths is a thumb sheath having a top and a bottom surface.

5. The glove of claim 4 wherein one of said tabs is disposed on the top portion of the thumb sheath.

6. The glove of claim 1 wherein said tabs extend from the end of said finger sheaths.

7. The glove of claim 1 wherein said tabs are integrally formed with said finger sheaths.

8. A sports glove having partially clad fingers, the glove for receipt of a hand having a palm, a back, and fingers, including a thumb finger, the top of the fingers having a nail portion, the glove comprising:

a. a first, second, third, and fourth finger sections, each of said first, second, third, and fourth finger sections having a top and bottom surface, the top surface disposed adjacent the nail side of the finger;

b. a fifth finger section having a top and bottom surface, the top surface disposed adjacent the nail side of the thumb;

c. a palm covering disposed adjacent the palm of the hand;

d. a back covering disposed adjacent the back of the hand; and e. a separate fin disposed on the top surface of the fifth finger section and the top surface of at least one of the other finger sections.

9. An athletic glove for receipt of a hand having a palm, a back, a thumb and fingers, the top of the fingers and thumb having a nail portion, the glove comprising:

a. at least one finger sheath, said finger sheath having a top and a bottom surface, said finger sheath disposed to extend only partially down a finger of the hand when said glove is fitted on the hand;

b. a thumb sheath having a top and bottom surface, said thumb sheath disposed to extend only partially down the thumb of the hand when said glove is fitted on the hand;

c. a palm covering disposed adjacent the palm of the hand;

d. a back covering disposed adjacent the back of the hand; and e. at least one triangular fin disposed on the top surface of said thumb sheath and the top surface of said finger sheath.

* * * * *